United States Patent [19]

Zenno

[11] Patent Number: 4,614,275

[45] Date of Patent: Sep. 30, 1986

[54] HEAVY DUTY CRANE

[75] Inventor: Yoshizumi Zenno, Kobe, Japan

[73] Assignee: Kabushiki Kaisha Kobe Seiko Sho, Kobe, Japan

[21] Appl. No.: 606,186

[22] Filed: May 2, 1984

[30] Foreign Application Priority Data

May 11, 1983 [JP] Japan ..... 58-82160

[51] Int. Cl.[4] ..... B66C 23/72

[52] U.S. Cl. ..... 212/198; 212/195

[58] Field of Search ..... 212/178, 195, 196, 197, 212/198

[56] References Cited

U.S. PATENT DOCUMENTS

| | | | |
|---|---|---|---|
| 3,140,857 | 7/1964 | Nickles . | |
| 3,202,299 | 8/1965 | Decuir . | |
| 3,485,383 | 12/1969 | Beduhn . | |
| 3,777,900 | 12/1973 | Brewer . | |
| 3,836,010 | 9/1974 | Lampson . | |
| 3,842,984 | 10/1974 | Brown et al. . | |
| 4,170,309 | 10/1979 | Lampson . | |
| 4,243,148 | 1/1981 | Lampson | 212/196 |
| 4,258,852 | 3/1981 | Juergens | 212/197 |
| 4,349,115 | 9/1982 | Lampson | 212/198 |
| 4,508,232 | 4/1985 | Lampson | 212/198 |

FOREIGN PATENT DOCUMENTS

| | | | |
|---|---|---|---|
| 203871 | 12/1967 | U.S.S.R. . | |
| 323606 | 2/1972 | U.S.S.R. | 212/195 |

OTHER PUBLICATIONS

"The Amazing Sky Horse" brochure (American).
"Transi-Lift" brochure (Lampson).
"Transi-Lift" brochure (Lampson).

*Primary Examiner*—Trygve M. Blix
*Assistant Examiner*—Thomas J. Brahan
*Attorney, Agent, or Firm*—Oblon, Fisher, Spivak, McClelland & Maier

[57] ABSTRACT

A heavy duty crane which essentially includes in combination: a first mobile and swivellable base unit, a boom mounted on the first base unit, a second mobile and swivellable base unit, a counterweight mounted on the second base unit, a link frame interconnecting the two base units, and a gantry structure supported on and across the two base units, wherein the link frame includes a front frame having a fore end thereof connected to the first base unit and a rear frame having a rear end thereof detachably connected to the second base unit, the rear end of the front frame being detachably connectible to the fore end of the rear frame and to the second base unit.

6 Claims, 6 Drawing Figures

HEAVY DUTY CRANE

BACKGROUND OF THE INVENTION

1. Field of the Invention

This invention relates to a heavy duty crane capable of hoisting ultra heavy loads.

2. Description of the Prior Art

Heavy duty cranes of this class usually employ a couple of mobile and swivellable base units which correspond to the base machine of an ordinary crane and which are connected with each other by a link frame, a boom mounted on one of the base units, a counterweight mounted on the other base unit, and a gantry provided across the two base units to interlink travelling and swivelling movements of the two base units. Such super size cranes are originally intended for operations of hoisting ultra heavy loads in a large open place, without giving much consideration to quick response in turning and travelling operations nor to the large operating ground space necessitated by a crane. However, as a matter of fact, they are not always used for hoisting ultra heavy loads which require their full capacities but are often used for handling smaller loads. In such a case, the lack of quick response in operation and the large operating ground space, which are inherent in a heavy duty crane, become hindrous in operation. More specifically, for turning a heavy duty crane, one base unit is moved around the other base unit, and, for moving the same for relocation, the two base units need to be simultaneously moved in the same direction at a uniform speed. These operations have to be performed carefully in a very elaborate and inefficient manner by a number of operators who closely communicate with each other. Moreover, the distance between the centers of the two base units measures about 36 meters in some cases and the crane as a whole extends over a distance of about 50 meters, requiring a very large operating ground space which is difficult to secure under some circumstances.

SUMMARY OF THE INVENTION

It is therefore an object of the present invention to provide a heavy duty crane which has an improved operational speed and permits a reduction in the operating ground space if desired or if circumstances require.

According to the present invention, there is provided a heavy duty crane which essentially includes in combination: a first mobile and swivellable base unit, a boom mounted on the first base unit, a second mobile and swivellable base unit, a counterweight mounted on the second base unit, a link frame interconnecting the two base units, and a gantry structure supported on and across the two base units, characterized in that the link frame comprises a front frame having a fore end thereof connected to the first base unit, and a rear frame having a rear end thereof detachably connected to the second base unit, the rear end of the front frame being detachably connectible to the fore end of the rear frame and to the second base unit.

The above and other objects, features and advantages of the present invention will become apparent from the following description and appended claims, taken in conjunction with the accompanying drawings which show by way of example some preferred embodiments of the invention.

DETAILED DESCRIPTION OF THE PREFERRED EMBODIMENTS

Figure 1:
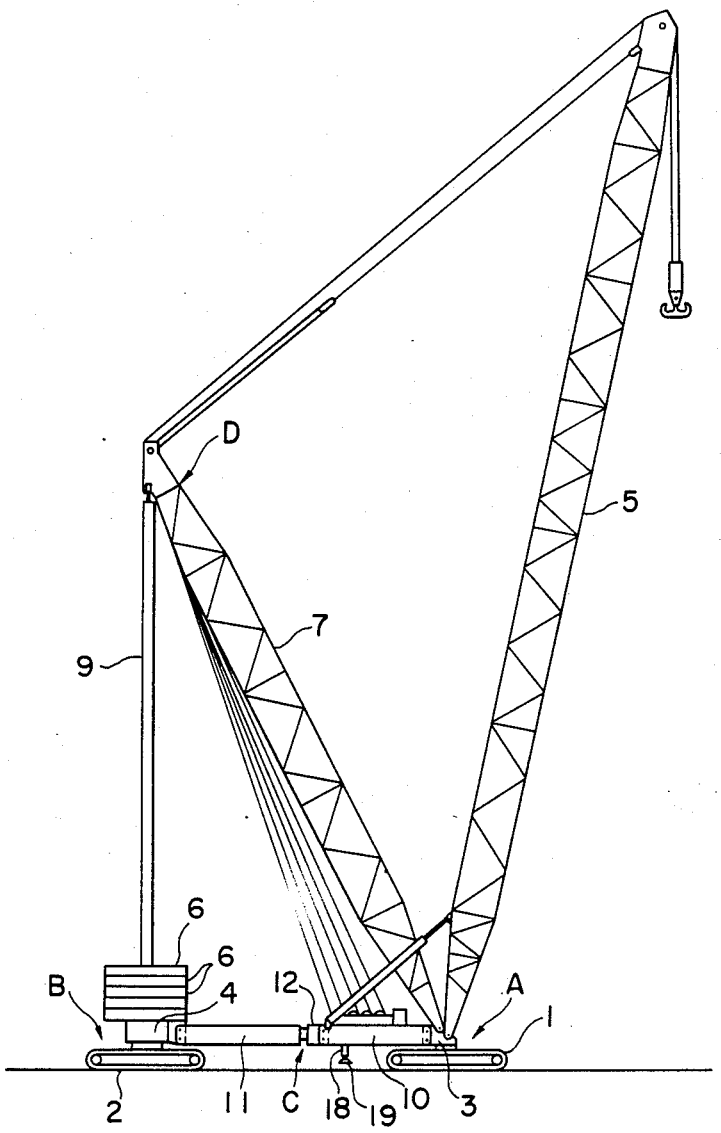
FIG. 1 is a schematic view of a heavy duty crane operating on its normal full scale.
Figure 2:
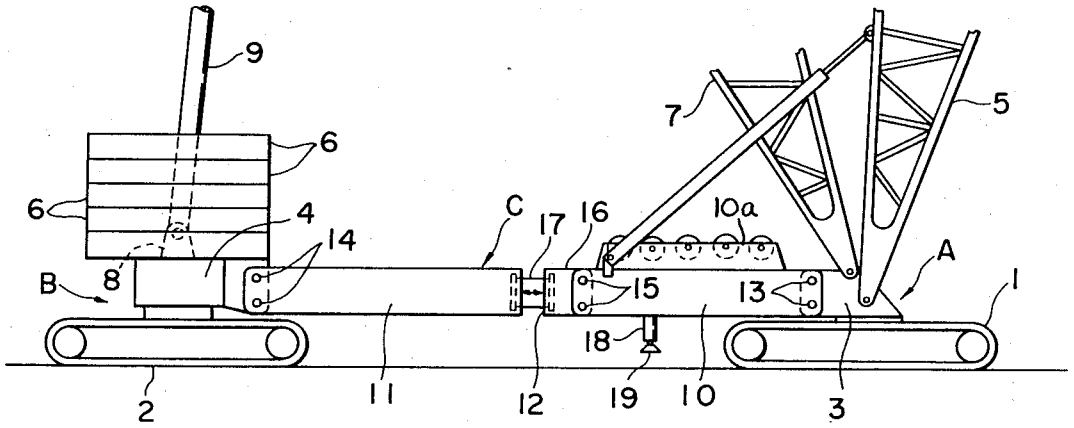
FIG. 2 is an enlarged schematic view of a base portion of the crane.

Referring to FIGS. 1 and 2, there is shown a heavy duty crane according to the present invention, which is generally constituted by a first base unit A, a second base unit B and a link frame C interconnecting the two base units A and B. The first and second base units A and B have swivel frames 3 and 4 rotatably mounted and disposed on crawler type vehicles 1 and 2, respectively. A boom 5 is flexibly mounted on the swivel frame 3 of the first base unit A, while a plurality of counterweights 6 are removably stacked on the swivel frame 4 of the second base unit 8. Further, a front gantry member 7 is rotatably mounted on the swivel frame 3 of the first base unit A, and a rear gantry member 9 in the form of a pipe is rotatably supported on the swivel frame 4 of the second base unit B through a bracket 8, the front and rear gantry members 7 and 9 being rotatable in the same direction as the boom 5 and their upper ends are pivotablly connected with each other to provide a gantry structure D.

The link frame C consists of a front frame 10 and a rear frame 11 the opposing ends of which are separably connected with each other through an intermediate member 12. A winch mechanism 10*a* for the boom and gantry member is mounted on the front frame 10. The fore end of the front frame 10 and the hind end of the rear frame 11 are detachably connected to the swivel frames 3 and 4 of the first and second base units A and B by pins 13 and 14, respectively. If desired, the front and rear frames 10 and 11 may be a box-like structure or a truss structure, or alternatively a compromise of these structures. The intermediate member 12 is constituted by a bracket 16 which is detachably fixed to the front frame 10 by upper and lower pins 15, and a cylindrical portion 17 which has its opposite ends connected to the bracket 16 and the rear frame 11, respectively, rotatable about the axis of the link frame C. Accordingly, the front and rear frames 10 and 11 are separated from each other upon detaching the bracket 16 of the intermediate member 12 from the front frame 10. The intermediate member 12 absorbs relative torsional movements of the front and rear frames 10 and 11 by rotation of the cylindrical portion 17 relative to the front and rear frames 10, 11. If one of the pins 15 is extracted, the remaining pin 15 holds the bracket 16 and front frame 10 in a pivotally connected state, absorbing the upward or downward flexing motions which would occur on a slope where the units A and B are supported at different levels. The pin connection between the bracket 16 of the intermediate member 16 and front frame 10 has the same construction as the pin connection between the rear frame 11 and swivel frame 4 of the second base unit B (in terms of position and diameter of pin fitting holes). Consequently, after detaching the rear frame 11 and intermediate member 12 from the second base unit B, it is possible to move the two base units A and B toward each other to connect the front frame 10 with the swivel frame 4 of the second base unit B.

The rear end of the intermediate link member 12 may be movably connected to the fore end of the rear frame 11 in the direction of the horizontal axis of the rear frame 11. For example, the cylindrical portion 17 of the intermediate member 12 is so designed as to be movable in the bore provided in the fore end of the rear frame 11 within a predetermined distance. By this arrangement, a slight movement of the second base unit B towards the first base unit A can be absorbed and does not affect the operation and the maintenance of the first base unit A, which results in a safe operation. The intermediate link member 12 may be of course connected to the front and rear frames 10 and 11 in a reversible manner to that mentioned above.

Further, the crane is provided with a couple of opposed vertical jack cylinders 18 (only one of them being shown in the drawings) on the lower side of the front frame 10. A float 19 which is provided at the lower end of each jack cylinder 18 contacts the ground when extended, to thereby push the front frame 10 upward in a manner as will be described in greater detail hereinbelow. Front frame 10 has mounted thereon a plurality of winches (not shown) for winding a hoisting wire rope and for varying the angle of the boom 5.

With the heavy duty crane of the above-described construction, operations for hoisting ultra heavy articles are performed in the full scale position in which the first and second base units A and B are set apart by a predetermined distance and interconnected by the link frame C as shown in FIGS. 1 and 2. Although the vehicles 1 and 2 of the first and second base units A and B are positioned in series in FIGS. 1 and 2, they may of course be positioned in different directions or phases to take suitable postures depending upon operating conditions.

On the other hand, the scale of the crane can be minimized according to the following procedures unless a large hoisting capacity is required, for the purpose of enhancing responsiveness in operation of the crane as a whole or minimizing the operating ground space (e.g., due to a limitation in a working place):

(a) The vehicles 1 and 2 of the two base units A and B are positioned in series as illustrated in FIGS. 1 and 2.

(b) The rear frame 11 of the link frame C and the bracket 16 of its intermediate member 12 are detached from the swivel frame 4 of the base unit B and the front frame 10, respectively, to remove the rear frame 11 and intermediate member 12 from the position between the second base unit B and front frame 10 by the use of another crane or a hoisting machine. In this separating operation, the pins 15 which connect the bracket 16 of the intermediate member and the front frame 10 can be extracted easily by raising the front frame 10 by extension of the jack cylinders 18.

Figure 3A:
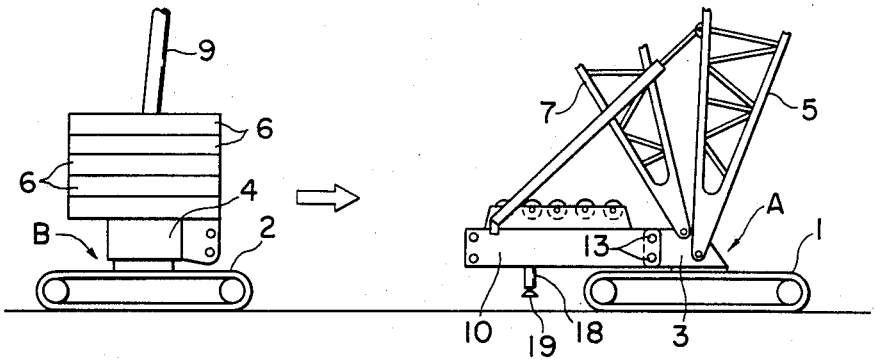
FIGS. 3(*a*) to 3(*c*) are views similar to FIG. 2 but showing the steps for contracting the crane to a smaller size.
Figure 3B:
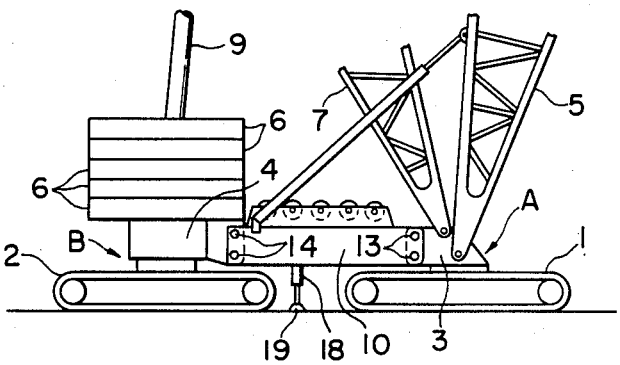
Figure 3C:
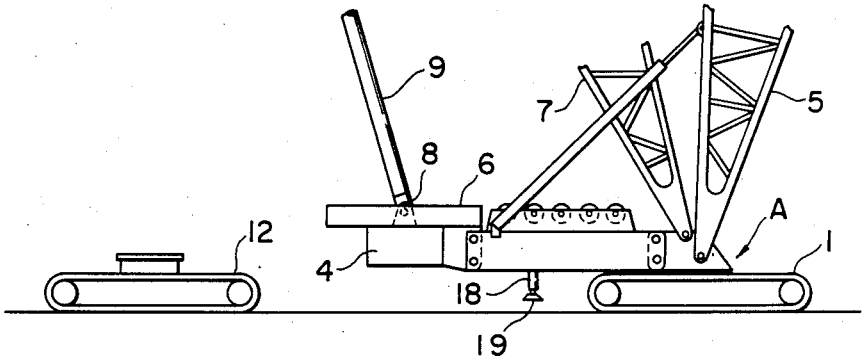

(c) After moving the second base unit B forward or toward the first base unit A as shown in FIG. 3(*b*), the front frame 10 is connected to the swivel frame 4 of the second base unit B by pins 14 (or 15). At this time, the jack cylinders 18 can be used effectively for facilitating the connection. As a result, the two base units A and B are held in a medium contracted state in which they are connected solely by the front frame 10.

(d) For a further reduction in size, an unnecessary part of the counterweights 6 is removed from the second base unit B as shown in FIG. 3(*c*), and the vehicle 2 of the base unit B is separated from the swivel frame 4 and moved into a receded position. The crane is now reduced to a size comparable to ordinary large size cranes, and is constituted of a base machine consisting of the first base unit A, front frame 10 of the link frame C, swivel frame 4 of the second base unit B and a required number of counterweights 6 and the gantry D. Although the hoisting ability of the crane is lowered to a considerable degree in this fully contracted state, it can be rotated and moved solely by operation of the first base unit A in a manner similar to ordinary cranes, permitting a drastic increase in the operational speed, responsiveness and to reduce its operating ground space to an ordinary size. In order to restore the initial position, the above-described procedures are performed in reverse order.

Figure 4:
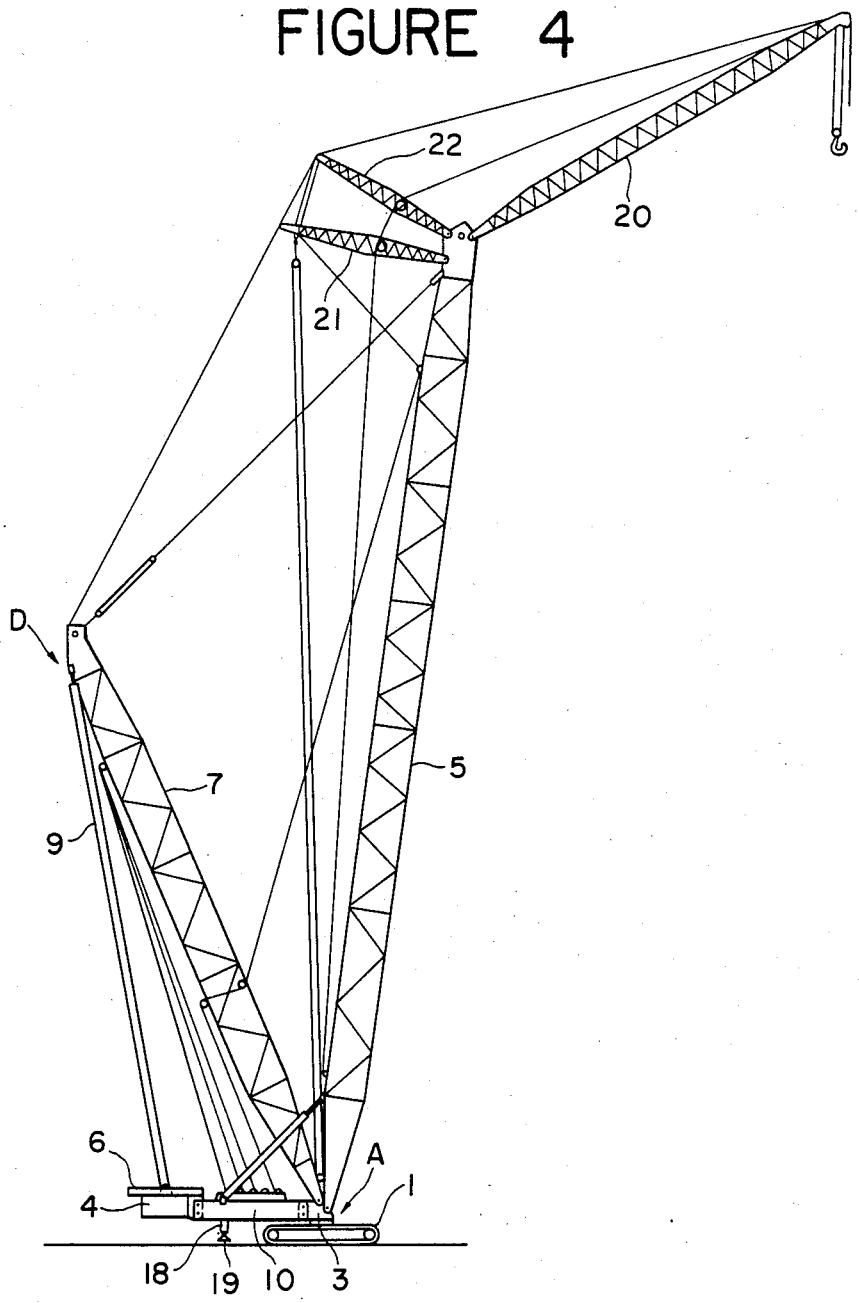
FIG. 4 is a view similar to FIG. 1 but showing the crane operating in a contracted state.

The jack cylinders 18 can be effectively used also in the conversion operation to the initial heavy duty position from the contracted state, and may be extended and securely positioned on the ground in the contracted states of FIGS. 3(*c*) and 4 to function as an outrigger for increasing the stability of machine support. Further, normally the boom angle is not changed in the contracted state in consideration of its hoisting capacity and instead a jib 20 is mounted at the fore end of the boom 5 as shown in FIG. 5 to perform hoisting operations through swinging movements of the jib 20. In FIG. 4, indicated at 21 and 22 are jib struts which are attached to the boom 5 along with the jib 20 prior to contraction of the crane.

The crane of the invention has been explained as being contractable to the sizes of FIGS. 3(*c*) and 4 in the foregoing description. However, in a case where it is desired to reduce only the operating ground space in a simpler way, the crane may be used in the intermediate contracted state of FIG. 3(*b*) in which the two base units A and B are interconnected by the front frame 10. In this state, there is no large drop in the hoisting capacity, so that it is possible to handle heavy loads. Besides, operational movements become more compact and speedy as compared with the full size position of FIGS. 1 and 2.

The present invention can be realized in other forms. For example, the base units A and B which are provided with crawler type vehicles 1 and 2 in the foregoing embodiment may employ wheeled vehicles to the same effect. Further, although the front and rear frames 10 and 11 of the link frame C are interconnected by the intermediate member 12 in the above-described embodiment, they may be directly connected with each other in a case where there is no need for taking into consideration the torsions or flexures of the link frame C or in a case where an anti-torsion or flexure means other than the intermediate member 12 is used. In addition to this connecting means, it is possible to employ bolts, nuts or other suitable means in place of pins for connecting the frames 10 and 11 to the base units A and B. If desired, the rear frame 11 may have a structure which is separable into a plurality of blocks. In such a case, removal and remounting of the rear frame 11 can be performed stepwise, making the contracting and expanding operations easier and safer. Otherwise, one or more of the separable blocks of the rear frame 11 may be removed to contract the total length of the crane temporarily. Moreover, with regard to the front and rear members 7 and 9 of the gantry structure U, it is possible to select arbitrary constructions instead of the particular examples shown.

As is clear from the foregoing description, the heavy duty crane according to the present invention can be contracted to a smaller size if desired so as to enhance the responsiveness of rotary and vehicle driving operations and to minimize the operating ground space, so that such can contribute greatly to enhancement of the versatility in operation and use of a heavy duty crane.

What is claimed is:

1. A heavy duty crane comprising:

a first mobile and swivellable base unit;

a boom mounted on said first base unit;

a second mobile and swivellable base unit;

a counterweight mounted on said second base unit;

a gantry structure on and across said first and second base units;

a link frame interconnecting said first and second base units along a line therebetween, said link frame comprising:

(a) a rigid front frame elongated along said line and having a fore end thereof connected to said first base unit by means preventing said front frame from pivoting about a horizontal axis relative to said first base unit;

(b) a rigid rear frame elongated along said line and having a rear end thereof detachably connected to said second base unit, and (c) an intermediate link member connecting said front and rear frames, said intermediate link member including means having a variable length along said line and permitting relative movement between said front and rear frames; and a winch mechanism for said boom and said gantry structure, said winch mechanism being mounted on said front frame.

2. The super size crane of claim 1, wherein said second base unit comprises a vehicle and a swivel frame removably mounted on said vehicle.

3. The super size crane of claim 1, wherein a jack cylinder with a float at the lower end thereof is provided on the unerside of a rear end portion of said front frame.

4. The crane of claim 1 including means on said link member between said front frame and said rear frame for permitting relative rotation between said front and rear frames about a horizontal axis.

5. The crane of claim 4 wherein said rear frame is connected to said second base unit by means preventing said rear frame from pivoting about a horizontal axis relative to said second base unit.

6. The super size crane of claim 1 wherein said intermediate link member comprises a bracket pivotably connected to one of said front and rear frames, and a cylindrical portion rotatably and slidably connected to the other of said front and rear frames.

* * * * *